US012504254B1

(12) United States Patent
Tsai

(10) Patent No.: US 12,504,254 B1
(45) Date of Patent: Dec. 23, 2025

(54) SHELL-THROWING TOY LONG GUN

(71) Applicant: Chin-Kuei Tsai, Changhua County (TW)

(72) Inventor: Chin-Kuei Tsai, Changhua County (TW)

( * ) Notice: Subject to any disclaimer, the term of this patent is extended or adjusted under 35 U.S.C. 154(b) by 0 days.

(21) Appl. No.: 18/951,946

(22) Filed: Nov. 19, 2024

(51) Int. Cl.
*F41B 11/72* (2013.01)
*F41B 11/55* (2013.01)
*F41B 11/62* (2013.01)

(52) U.S. Cl.
CPC ..... *F41B 11/72* (2013.01); *F41B 11/55* (2013.01); *F41B 11/62* (2013.01)

(58) Field of Classification Search
CPC ..... F41B 11/00; F41B 11/55; F41B 11/62; F41B 11/60; F41B 11/642; F41B 11/721; F41B 11/722; F41B 11/723; F41B 11/89; F41B 11/72
USPC ..... 124/73, 58, 71, 74, 76
See application file for complete search history.

(56) References Cited

U.S. PATENT DOCUMENTS

2015/0377582 A1* 12/2015 Kang ..... F41B 11/73 124/71
2020/0232744 A1* 7/2020 Lin ..... F41B 11/642

FOREIGN PATENT DOCUMENTS

CN 103217061 A * 7/2013
CN 208458577 U * 2/2019
CN 209763872 U * 12/2019 ..... F41B 11/55
CN 215447598 U * 1/2022
CN 216115616 U * 3/2022
JP 2022167703 A * 11/2022
TW M497259 U * 3/2015

* cited by examiner

*Primary Examiner* — John Cooper

(74) *Attorney, Agent, or Firm* — Demian K. Jackson; Jackson IPG PLLC

(57) ABSTRACT

A shell-throwing toy long gun includes a valve assembly that controls whether the high-pressure gas output from an air supply unit can flow to a gun mechanism. The valve assembly includes a valve stem, an air outlet, a sealing rings and collars fitted on the outer side of the valve stem, a sleeve, and a spring. The valve stem can be moved by the impact of a hammer from a striking unit. One end of the air outlet is provided with a first connecting tube, and one end of the sleeve is provided with a second connecting tube. The first connecting tube and the second connecting tube are correspondingly connected to cover the air passage within the valve stem, preventing the leakage of high-pressure air. The air supply unit includes a cylinder connector, which can be connected to a gas cylinder and is disposed inside the grip.

20 Claims, 6 Drawing Sheets

SHELL-THROWING TOY LONG GUN

BACKGROUND OF INVENTION

1. Field of the Invention

The present invention relates to toy guns, and more particularly to a shell-throwing toy long gun.

2. Description of Related Art

Various types of toy guns are known, such as pistols, long guns, and shotguns, with their structures mostly imitating real guns. Toy long guns do not fire toy bullets; instead, they employ mechanical or pneumatic devices to produce sound, light, or other effects to simulate the actual state of a real gun when fired. For example, toy long guns on the market can eject toy bullets from a shell-throwing port on the side of the gun body to mimic the effect of a real gun ejecting shells, making their use more realistic and enjoyable.

Furthermore, the methods for driving the ejection of toy bullets from toy long guns are mainly divided into pneumatic and electric types. Among these, pneumatic types are more common, primarily utilizing high-pressure air supplied by a gas cylinder to drive the gun mechanism. The movement of the gun mechanism rapidly ejects toy bullets, and the gas cylinder is replaceably installed inside the grip of the toy long gun. Inside the gun body of the toy long gun is a valve assembly that controls the flow of high-pressure air to the gun mechanism, thereby driving it. As shown in FIG. 1 to FIG. 3, the valve assembly consists of a valve component 1, a sealing rings and collars 2, an air outlet 3, a spring 4, a fixed ring 5, and an O-ring 6. The valve component 1 is rod-shaped, with an air inlet hole 7 at its bottom side and an air duct 8 that connects the inlet hole 7. The air duct 8 extends to the left end of the valve component 1 to correspond to the air outlet member 3. The collar 2 and the air outlet member 3 are fixed inside the gun body and are positioned at the right and left ends of the valve component 1, covering the air inlet hole 7. The spring 4 is set around the outside of the valve component 1, with one end of the spring 4 pressed against a convex ring on the outside of the valve component 1 and the other end attached to the fixed ring 5. The fixed ring 5 is located inside one of the insertion tubes 9 of the air outlet member 3, with the O-ring 6 positioned between the fixed ring 5 and the inner end of the insertion tube 9.

The right end of the valve component 1 corresponds to a hammer of the toy long gun. When the toy long gun is fired, the hammer strikes the right end of the valve component 1, causing it to move towards the air outlet 3. High-pressure air from the gas cylinder can then enter the air inlet hole 7 and pass through the air duct 8 and air outlet 3 to reach the gun mechanism, driving it to move. The O-ring 6 not only prevents air leakage but also absorbs the impact force of the hammer (as the fixed ring 5 strikes the O-ring 6 during the momentary movement of the valve component 1). Since the O-ring 6 is made of elastic material and is relatively small, repeated impacts by the end of the fixed ring 5 will lead to elastic fatigue, resulting in deformation or even rupture, causing high-pressure gas to leak through the gap between the fixed ring 5 and the insertion tube 9. This, in turn, affects the movement of the gun mechanism and the accuracy of the shell-throwing action.

Additionally, conventional toy long guns connect the gas cylinder 112 through a connection assembly 111 inside the grip. The connection assembly 111 includes a shell-shaped lock member 113, a tubular puncture valve 114, a bolt lock 115 and an anti-leakage ring116. The lock member 113 is roughly inverted Y-shaped, with one end locked inside the grip and the other end into which the gas cylinder 112 is inserted. The bolt lock 115 is placed on one end of the lock 113, the puncture valve 114 is inserted inside the lock member 113, with the anti-leakage ring 116 positioned at the inner end of the puncture valve 114 to prevent gas leakage between the puncture valve 114 and the inner side of the lock member 113. The tip of the puncture valve 114 punctures the gas cylinder 112, allowing high-pressure gas to flow through the puncture valve 114 and the lock member 113 to the valve assembly. This type of gas cylinder connector 111 consists of multiple components, increasing manufacturing costs and complicating assembly.

SUMMARY OF THE INVENTION

The main purpose of the present invention is to provide a shell-throwing toy long gun that not only avoids the high-pressure gas leakage problem caused by the failure of the anti-leakage ring in conventional shell-throwing toy long guns but is also more durable. Moreover, the gas cylinder connector is simpler and less costly to manufacture, making it economically efficient and practical.

To achieve the above purpose, the present invention provides an improved shell-throwing toy long gun, comprising a gun body, an air-control unit, a striking unit, an high-pressure air supply unit, and a cartridge clip. The gun body comprises a detachable lower body and an upper body. The lower body includes a cartridge clip socket and a grip, while the upper body features a shell-throwing port and a gun mechanism on one side and inside the upper body. The air-control unit and striking unit are located inside the lower body, and the high-pressure air supply unit is installed in the grip. The high-pressure air supply unit supplies gas to the air-control unit, and the cartridge clip is detachably inserted into the cartridge clip socket. The air-control unit includes a lower control module and an upper control module. The high-pressure gas output from the high-pressure air supply unit can be delivered to the gun mechanism through the lower and upper control modules to drive the gun mechanism. The toy bullets loaded from the cartridge clip into the lower body can be ejected from the shell-throwing port by the movement of the gun mechanism. The high-pressure air supply unit connects to the lower control module, and the striking unit connects to one end of the upper control module. A valve assembly is installed inside the upper control module, with one end corresponding to a hammer (striking component) in the striking unit. The valve assembly regulates high-pressure gas flow to the gun mechanism from the lower control module to the gun mechanism. The valve assembly comprises a valve stem, an air outlet, and a sealing rings and collars and a sleeve surrounding the valve stem. The valve stem is rod-shaped, with an internal air passage extending from one end to an air inlet hole on the side of the valve stem. One end of the valve stem corresponds to a hammer (striking component) of the striking unit, which moves the valve stem when struck. The air outlet is fixed inside the upper control module, taking a hollow cylindrical form for outputting high-pressure air from the valve stem's air passage. It is equipped with a first connecting tube at one end. The rings and sleeve are fitted at both ends of the valve stem. The rings are fixed inside the upper control module to cover the air inlet holes. When the valve stem moves, the air inlet holes are exposed and correspond to an air duct in the lower control module. The sleeve is hollow cylindrical with a fixing section and a second connecting tube at its two ends. The spring is fixed at one end of the valve stem, and the second connecting tube connects to the first connecting tube, covering the air passage of the valve stem and preventing high-pressure air from leaking.

BRIEF DESCRIPTION OF THE DRAWINGS

Hereinafter, two better embodiments of the present invention are cited and described in further detail with the drawings, wherein.

DETAILED DESCRIPTION OF THE INVENTION

Figure 1:
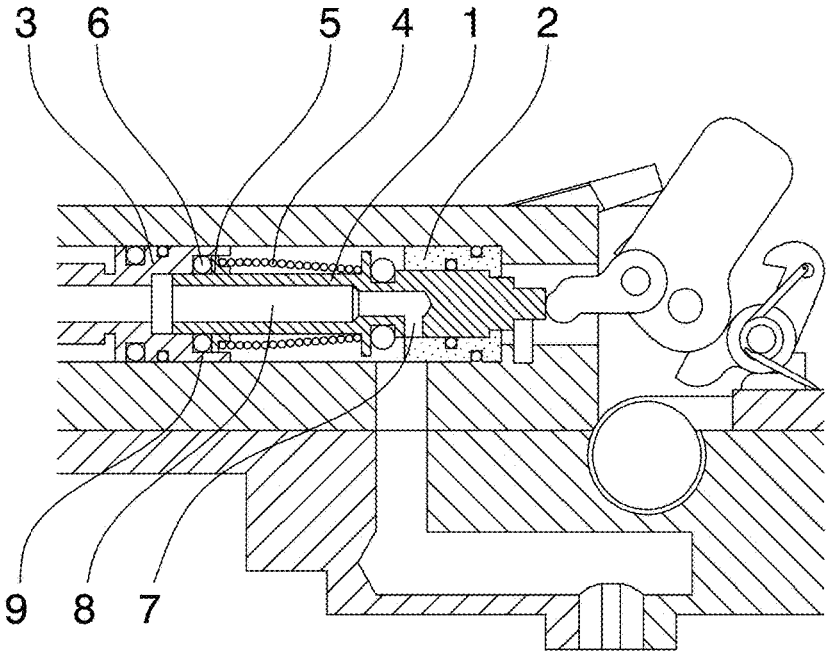
FIG. 1 (PRIOR ART)
FIG. 1 is a schematic view of the valve assembly in a conventional shell-ejecting toy long gun.
Figure 2:
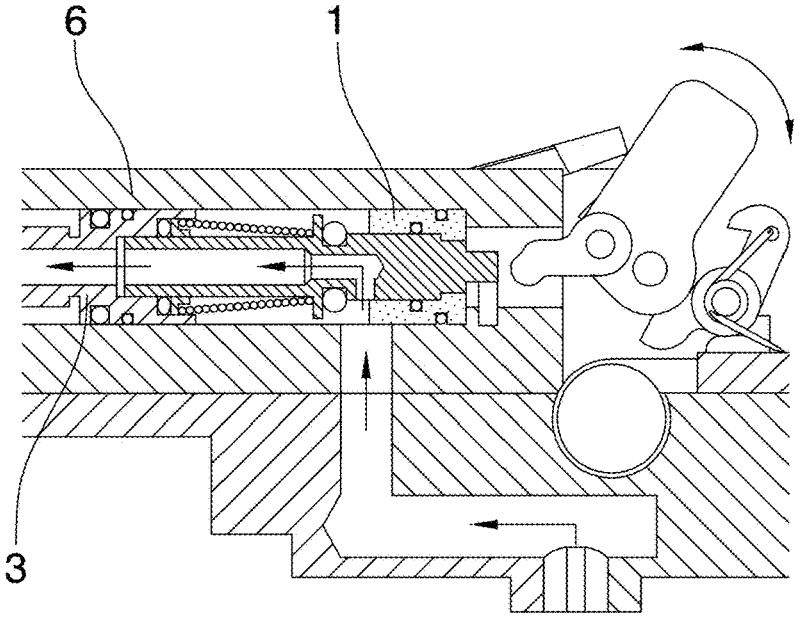
FIG. 2 (PRIOR ART)
FIG. 2 is a schematic diagram showing the gas flow in a conventional shell-ejecting toy long gun.
Figure 3:
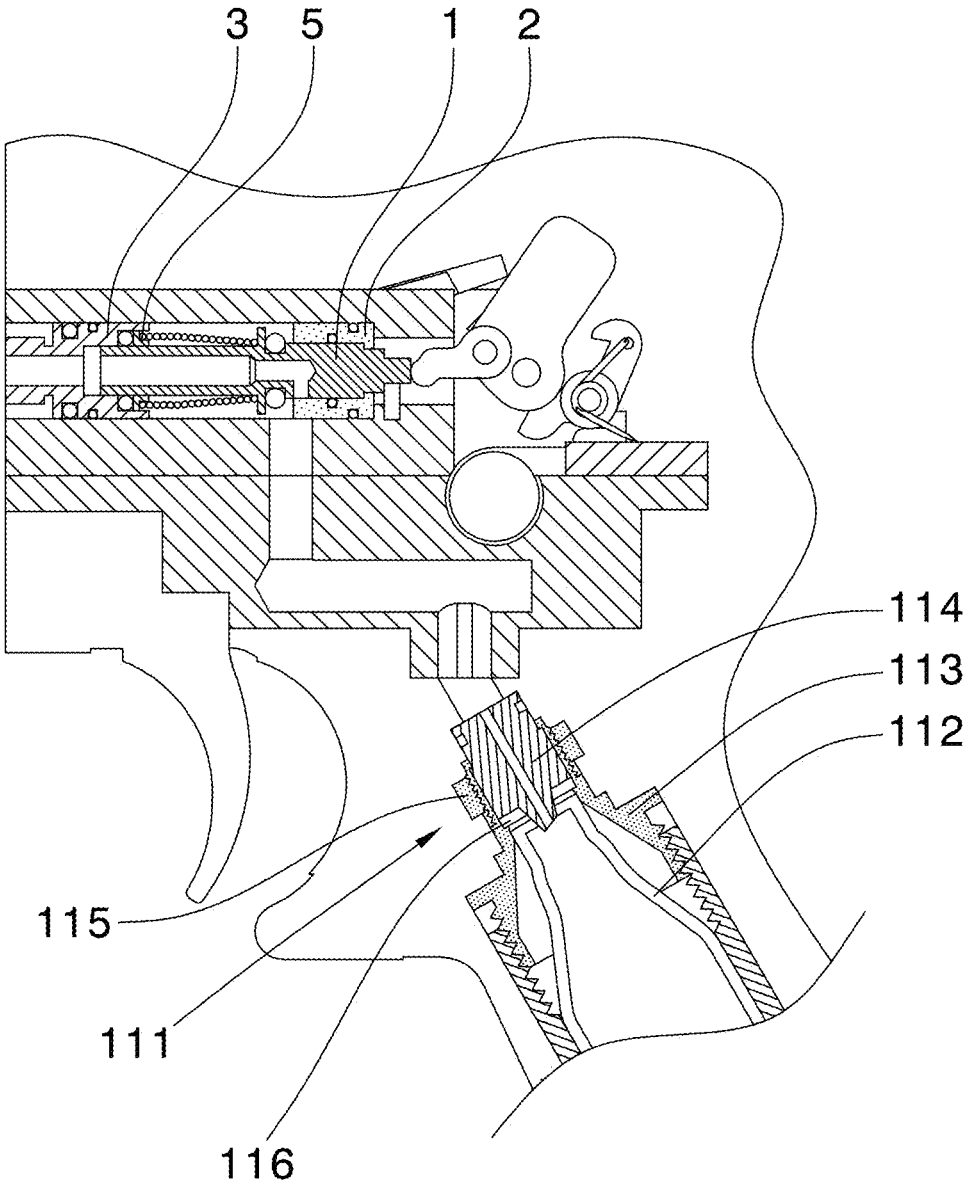
FIG. 3 (PRIOR ART)
FIG. 3 is a schematic view showing the connection between the gas cylinder connector and the gas cylinder in a conventional shell-ejecting toy long gun.
Figure 4:
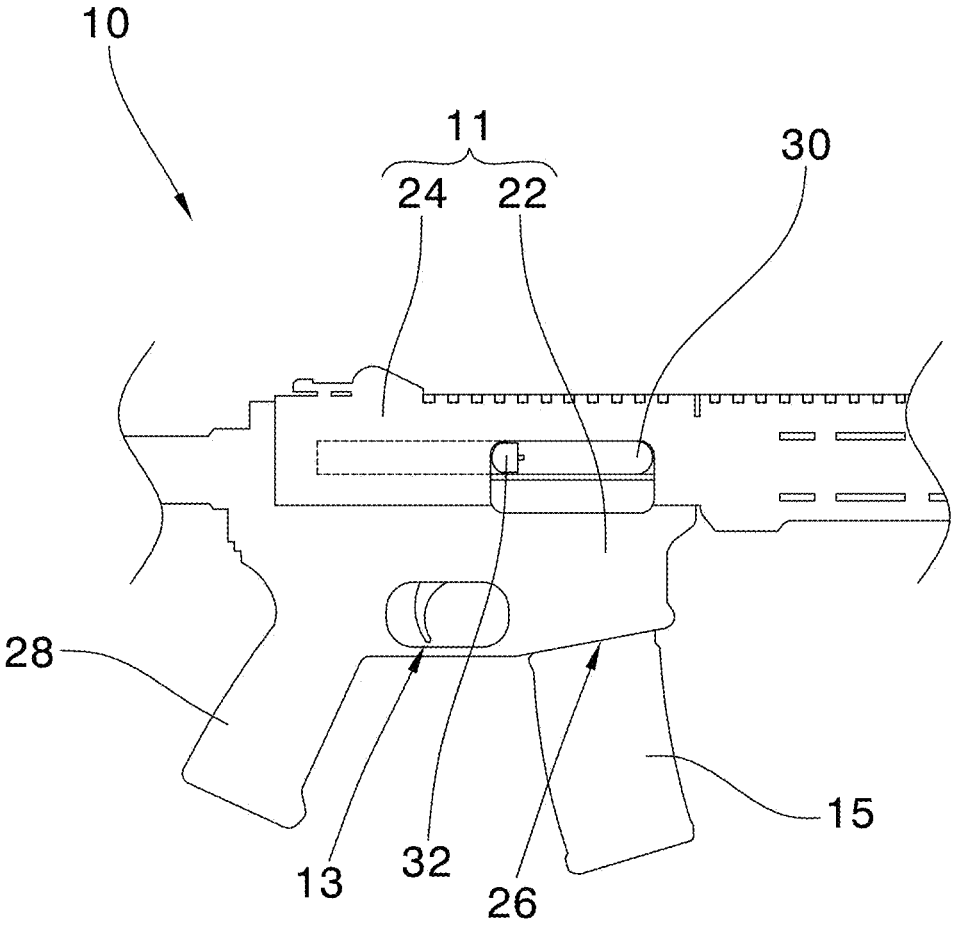
FIG. 4 is a partial exterior schematic view of a preferred embodiment of the present invention.
Figure 5:
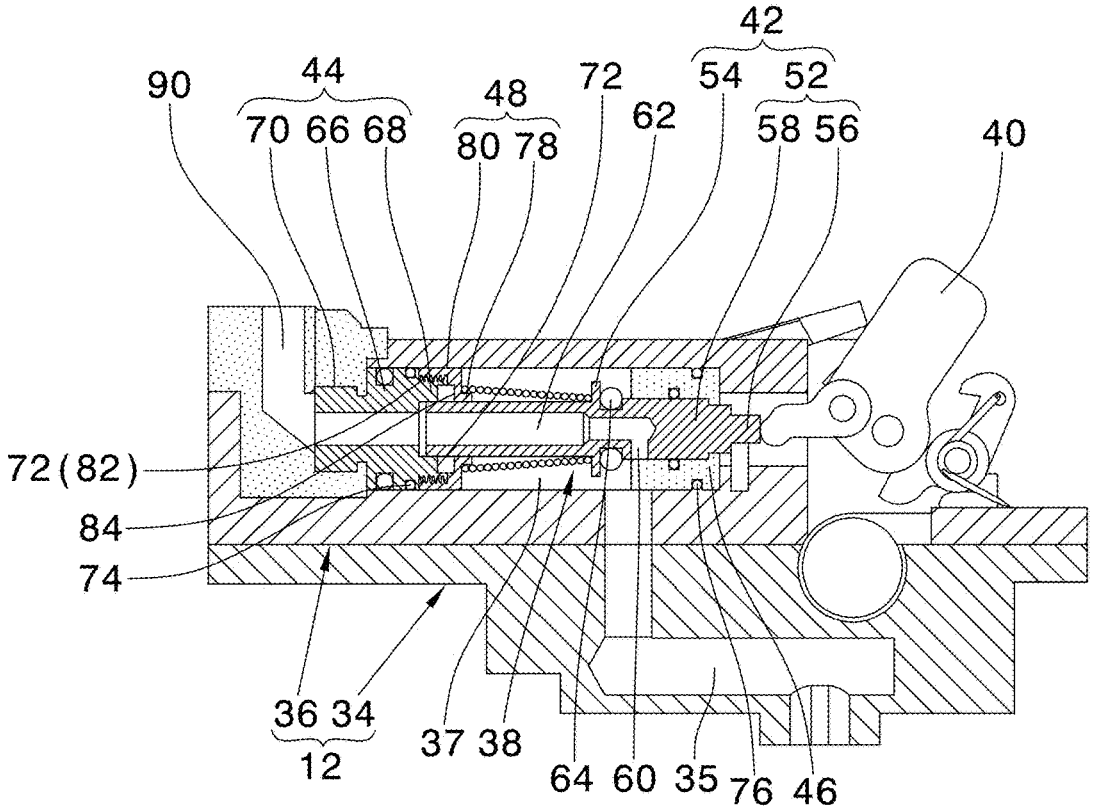
FIG. 5 is a schematic view of the valve assembly in a preferred embodiment of the present invention.
Figure 6:
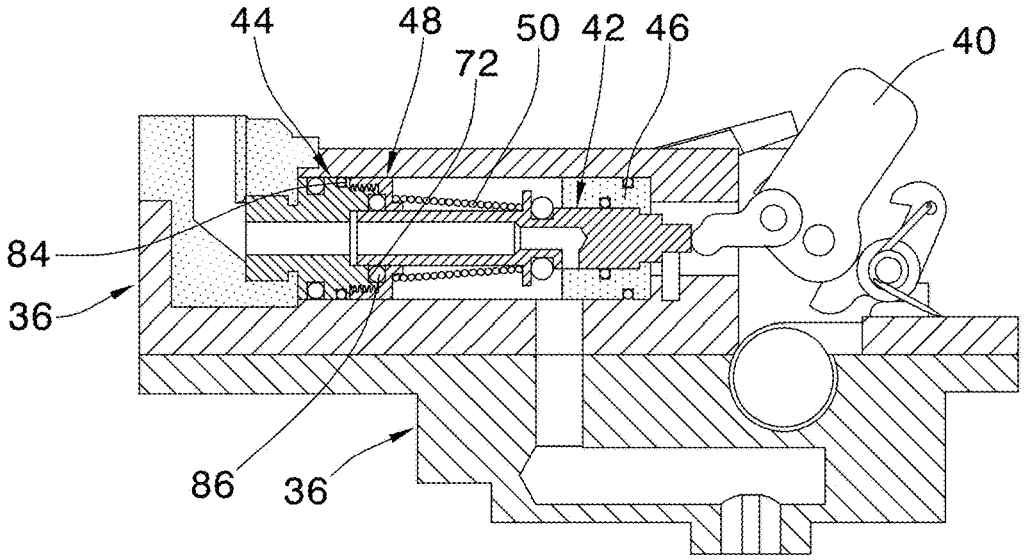
FIG. 6 is a schematic view of the valve assembly in another preferred embodiment of the present invention.
Figure 7:
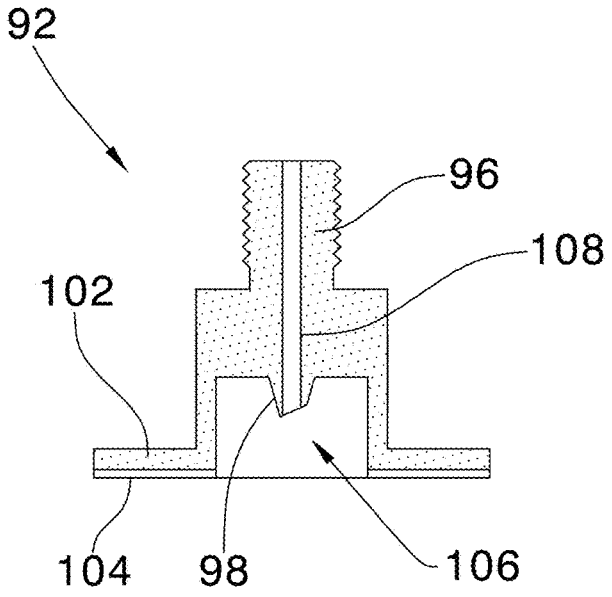
FIG. 7 is a sectional view of the gas cylinder connector in a preferred embodiment of the present invention.
Figure 8:
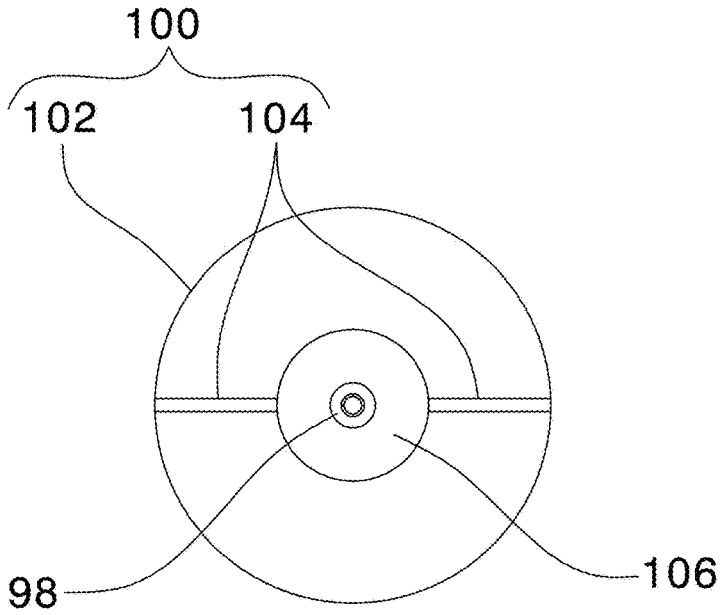
FIG. 8 is a bottom side view of the gas cylinder connector in a preferred embodiment of the present invention.
Figure 9:
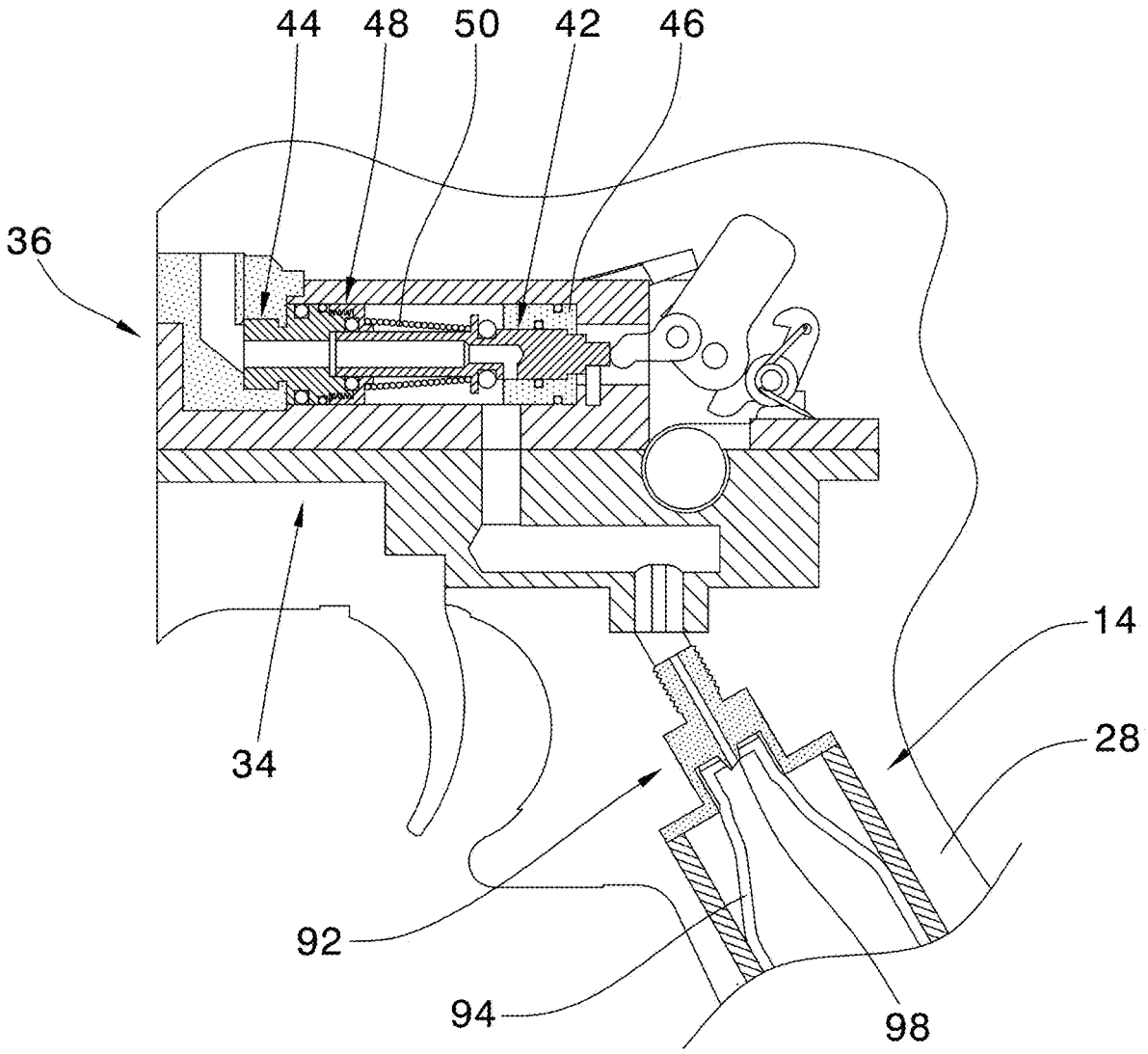
FIG. 9 is a schematic view showing the connection between the gas cylinder connector and the gas cylinder in a preferred embodiment of the present invention.

First, please refer to FIG. 4 to FIG. 9, the shell-throwing toy long gun 10 of a better embodiment of the present invention contains a gun body 11, an air control unit 12, a striking unit 13, an air supply unit 14, and a cartridge clip 15, the gun body 11 contains a detachable lower body 22 and an upper body 24, the lower body 22 contains a cartridge clip socket 26 and a grip 28, the upper body 24 is provided on one side and the inner part respectively. The upper gun body 24 is equipped with a shell disposal port 30 and a gun mechanism 32 on one side and inside respectively, the gas control unit 12 and striking unit 13 are located in the lower gun body 22, the gas supply unit 14 is located in the grip 28, which outputs high-pressure gas to the gas control unit 12, the cartridge is detachably inserted in the cartridge socket 26, the gas control unit 12 contains a lower control module 34 and an upper control module 36, the gas supply unit 14 outputs high-pressure gas, the gas supply unit 14 outputs high-pressure gas, the gas supply unit 14 outputs high-pressure gas, the gas supply unit 14 outputs high-pressure gas, the gas supply unit 14 outputs high-pressure gas, the gas supply unit 14 outputs high-pressure gas. The high pressure gas output from the gas supply unit 14 can be transmitted to the gun mechanism 32 through one of the gas transmission pipes 35 of the lower control module 34 and the upper control module 36, in order to use the high pressure gas to promote the movement of the gun mechanism 32, and the bullet input into the lower body 22 can be thrown out of the shell-throwing port 30 by the action of the movement of the gun mechanism 32, the gas supply unit 14 is connected to the lower control module 34, and the striking unit 13 is connected to the upper control module 36 at one end, the upper control module 36 is connected to the upper control module 36 at one end, the upper control module 36 is connected to the upper control module 36 at one end, and the upper control module 36 is connected to the upper control module 36 at one end. The upper control module 36 is connected to one end of the upper control module 36, the upper control module 36 is equipped with two openings at one end of the holding space 37, an air valve assembly 38, located inside the holding space 37, one end of the air valve assembly 38 corresponds to one of the hammers 40 of the striking unit 13, the air valve assembly 38 controls the flow of high pressure gas from the lower control module 34 to the gas piping 35 to the gun barrel 32; the foregoing the body 11, the gas control unit 12, the striking unit The body 11, the air control unit 12, the striking unit 13, the air supply unit 14, the cartridge clip and the lower body 22, the upper body 24, the cartridge clip socket 26, the grip 28, the shell throwing port 30, the receiver 32, the lower control module 34, the upper control module 36, the hammer 40 are all the same as those of the customary shell-throwing toy pistol, and we will not go into the details of the structure and mode of operation of each of the components herein, and the features of the shell-throwing toy pistol 10 of the present invention are The feature of the shell gun 10 of the present invention is the following:

The valve assembly 38 comprises a valve stem 42, an outlet 44, a ring 46, a sleeve 48, a spring 50, a rod 42, which is movable inside the upper control module 36, a body 52 and a collar 54, a first section 56 and a second section 58, which is larger in outside diameter than the first section 56, an inlet 60, which is located in the second section 58, and an inlet hole 60, which is located in the second section 58, and an inlet hole 60, which is located in the second section 58. The second section 58 has an outer diameter larger than the first section 56, an air inlet hole 60 located at the end of the second section 58 adjacent to the first section 56, an air passage 62 extending from the air inlet hole 60 to the other end of the second section 58, the end of the first section 56 is a hammer (striking component) 40 corresponding to the striking unit 13, which, when the striking unit 13 is actuated to cause the hammer (striking component) 40 to strike the end of the first section 56 of the valve stem 42, can cause the valve stem 42 to move, and a butt ring 54 protrudes annularly from the second section 58 adjacent to the second section 58 to the other end of the second section 58. The second section 58 is located adjacent to the air inlet 60, and an airtight ring 64 is provided between this ring 54 and the air inlet 60. The air outlet 44 is in the form of a hollow cylinder, which is fixed inside the upper control module 36, for the output of high pressure air conveyed by the air path 62 of the valve stem 42, and has a tube 66, with a first connecting tube 38 and a socket 70 at both ends of the tube 66, and an inner diameter of the tube 66 is larger than that of the valve stem 42, with a diameter of 1.5 mm. The inner diameter of the tube 66 is larger than the outer diameter of the second section 58 of the valve stem 42, and the first connecting tube 38 corresponds to the second section 58, with a threaded portion 72 on the inner side and a first end face 72 on the inner end, and the first connecting tube 38 is equipped with a hermetic ring 74 on the outer side against the inside of the holding space 37 of the upper control module 36. The collar 46 is in the shape of a ring, which is fixed in the interior of the holding space 37 and set on the outside of the second section 58 of the valve stem 42 to cover the air inlet hole 60, when the hammer (striking component) 40 strikes the end of the first section 56 it can push the valve stem 42 to move, and then the air inlet hole 60 is not covered by the collar 46 and exposed, and when the air inlet hole 60 is exposed it is corresponded to the gas transmission pipeline 35 of the lower control module 34, also, the first connecting tube 38 is equipped with a gas tight ring 74 on the outside. The collar 46 has an airtight ring 76 on the outside of the collar 46 against the inside of the holding space 37. The sleeve 48 is in the form of a hollow cylinder, which is socketed at the end of the second section 58 corresponding to the first connecting tube 38, with a fixing portion 78 and a second connecting tube 80, the inner diameter of the fixing portion 78 is smaller than the inner diameter of the second connecting tube 80, the fixing portion 78 is live-sleeved to the outer side of the end of the second section 58, and there is a threaded portion 82 on the inner side of the second connecting tube 80 with a second end surface 84 on the inner side, which is parallel to the gas delivery pipe 35 of the lower control module 34, and the ring 46 is also equipped with a gas-tight ring 76 on the outer side to resist to the inner side of the holding space 37. The second end face 84 is parallel to the first end face 72, and the threaded portion 82 can be screwed against the threaded portion 72 for the sleeve 48 to use the threaded portion 82 of the second connecting tube 80 to lock together with the threaded portion 72 of the first connecting tube 38 of the air outlet member 44, so as to shield the airway 62 of the valve stem 42 from the leakage of the high-pressure air conveyed by the airway 62, and if for the sake of improving the leak proofness of the air outlet member 44 connected to the sleeve 48, the second connecting tube 80 is provided with a threaded portion 82 on the inner side and a second end face 84 on the inner end. In order to improve the air leakage prevention effect of the connection between the air outlet 44 and the sleeve 48, a leakage prevention ring 86 can be added to the air outlet 44 and the sleeve 48 so that the leakage prevention ring 86 can be sandwiched between the first end 72 and the second end 84 of the first and second connecting tubes 38, 80, and the inner diameter of the leakage prevention ring 86 is larger than the outer diameter of the second end 58 of the valve stem 42. Of course, the leak proof ring 86 is not necessary. One end of the spring 50 is attached to the fixing portion 78, and the other end is attached to the retaining ring 54 on the outside of the valve stem 42, whereby the retaining ring 54 can be held against one end of the collar 46 by the elastic tension of the spring 50 and the valve stem 42 can be resiliently restored to its original position after it has been moved by the hammer (striking component) 40.

In addition, the upper control module 36 contains an air guide 88, which is made of elastic material, such as rubber, but not limited to, and is plugged into one of the open ends of the holding space 37 (the first section 56 of the valve stem 42 is located at the other open end of the holding space 37), and there is an L-shaped air outlet 90 located internally in the air guide 88, and the plug portion 70 of the air outlet 44 is plugged into the bottom end of the air outlet 90, and the top end of the air outlet 90 is connected to the bottom end of the air outlet 90, and the top end of the air outlet 90 is connected to the top end of the air outlet 90. The top end of the air outlet 90 is connected to the gun 32.

In addition, the gas supply unit 14 contains a cylinder connector 92, a cylinder 94 and an elastic member 95, the cylinder connector 92 is located in the interior of the grip 28 for the cylinder 94 into the interior of the grip 28 can be used to make the cylinder 94 high-pressure gas output to the gas control unit 12 under the control module 34, the cylinder connector 92 contains a screw 96, a puncture nozzle 98 and a locking portion 100, the screw 96 is detachable, the screw is detachable, the nozzle 98 is detachable, the screw 96 is detachable, the screw 96 is detachable, the screw 96 is detachable, the screw 96 is detachable, the screw 96 is detachable. The screw 96 is detachably locked inside the grip 28, the piercing nozzle 98 is in the shape of a cone and is located at one end of the screw 96 for piercing the cylinder 94, the locking part 100 has a piece 102 and a groove 104, the piece 102 is located at one end of the screw 96 opposite to the piercing nozzle 98, there is an indentation 106 on the piece 102 which extends into the inner side of the screw 96, and the indentation 106 extends into the inner side of the screw 96, and the locking part 100 contains a piece 102, a groove 104, and the locking part 100 contains a piece 102 and an indentation 104. The screw 96 is provided with a recess 106 which extends into the inside of the screw 96, the recess 104 is provided on the outside of the body 102 through the recess 106, which can be used for a one-handed tool (e.g., a wrench, not shown in the drawings) to be attached to the recess 104 to rotate the gas cylinder connector 92, locking the gas cylinder connector 92 into the inside of the grip 28, and the puncture nozzle 98 is provided within the recess 106, with an air hole 106 penetrating through the tip of the puncture nozzle 98 to the screw 96. the gas cylinder 94 is a carbon dioxide cylinder. The gas cylinder 94 is a carbon dioxide cylinder. Based on this, the cylinder connector 92 is locked inside the grip 28, after the cylinder 94 is inserted into the grip 28, the piercing nozzle 98 pierces and opens the cylinder 94, and the high pressure gas inside the cylinder 94 will flow to the lower control module 34 through the air hole 106, so that the high pressure gas accumulates between the air hole 106 and the gas pipeline 35 of the lower control module 34, and then controlled to flow to the gun 32 or not by the valve assembly 38. The elastic member 95 is a spring, which is located between the body 102 and the gas cylinder 94, to provide the elastic force to push out the gas cylinder 94 and to facilitate the replacement of the gas cylinder 94.

Thus, when the user pulls the trigger of the striking unit 13, the hammer (striking component) 40 strikes the end of the first section 56 of the valve stem 42, which causes the valve stem 42 to be instantaneously pushed (displaced toward the muzzle), exposing the air inlet hole 60 and releasing the high-pressure gas, which flows to the gun 32 from the gas pipeline 35 through the air duct 62, the first and second connecting tubes 38, and the air duct 90 of the air conductor 88, and then flows to the gun 32 through the air duct 90, the first and second connecting tubes 38, and the air duct 90 of the air guide 88. The high pressure gas can then flow from the gas delivery pipe 35 through the air duct 62, the inner part of the first and second connecting tubes 38 and the outlet channel 90 of the air guide block 88 to the gun mechanism 32, which will cause the gun mechanism 32 to be displaced to complete the action of shell throwing. Secondly, when the valve rod 42 is struck by the hammer (striking component) 40, the spring 50 is compressed by the fixed and immobile air outlet 44, sleeve 48 and air guide 88, therefore, after the hammer (striking component) 40 is restored to its position, the valve rod 42 can be resiliently restored by the elastic tension of the spring 50, so as to cover the inlet holes 60 and stop the output of the high pressure gas.

The retaining ring at one end of the valve component of the shell thrower is for the spring to be fixed at one end, and the retaining ring is located in the plug tube at one end of the air outlet member, and there is a leak-proof ring between one end of the retaining ring and the inner wall of the plug tube, which is used to absorb the force of the hammer (striking component) strike and prevent air leakage (when the hammer (striking component) strikes, the valve component moves instantaneously, causing one end of the retaining ring to strike the leak-proof ring). Since the anti-leakage ring is made of elastic material (mostly silicone) and is O-shaped and small in size, repeated impacts on one end of the fixed ring block will cause deformation or even rupture in a short period of time due to elastic fatigue, resulting in high-pressure gas leakage from the anti-leakage ring to the outside of the fixed ring block, which in turn affects the accuracy of the movement of the pistol mechanism and the shell-throwing action, etc. In comparison with the customary shell-throwing toy pistol, the valve stem 42 of the present invention is subjected to a high pressure and high pressure when hit by the hammer (striking component) 40. When the valve rod 42 is struck and pushed by the hammer (striking component) 40, the striking force of the hammer (striking component) 40 is transmitted to the air guide 88 by the spring 50, the first and second connecting tubes 38 and 80 of the air outlet 44 and the sleeve 48, which are made of elastic material, larger in size and not in the shape of a ring (the size of which is several times more than the leakage-proof ring), which can absorb the striking force and is not easy to be deformed over time, The structure of the inflator 44 and the first and second connecting tubes 38 and 80 of the sleeve 48 is different from the separate structure of the inflator and the retaining ring in the customary shell-throwing toy pistols. Therefore, the present invention does not have the problem of high-pressure gas leakage in the use of the customary shell-throwing toy pistols as mentioned above, and it is obviously more durable than the customary shell-throwing toy pistols.

In addition, the cylinder connector 92 of the present invention is a single element, which has the effect of locking inside the grip 28 and connecting to the cylinder 94 at the same time. Compared with the customary shell-throwing toy long gun where the gas cylinder connector is composed of shell-shaped locking member, tubular puncture valve and leak-proof ring, the structure of the cylinder connector 92 is obviously more streamlined, which is not only cheaper to produce, but also eliminates the need to install a leak-proof ring to avoid air leakage. The structure of the gas cylinder connector 92 is obviously simpler, not only the production cost is lower, but also there is no need to install the anti-leakage ring to avoid air leakage, which is economical and practical.

In summary, the novel structure of the valve assembly and the air supply unit of the shell-throwing toy long gun provided by the present invention not only eliminates the problem of high pressure gas leakage caused by the failure of the anti-leakage ring of the valve assembly in the customary shell toy pistol, but also provides a more durable shell toy pistol than the customary shell toy pistol; furthermore, the cylinder connector of the air supply unit is a single component, which is simpler in structure than the gas cylinder connector of the cylinder in the customary shell toy pistol. Moreover, the cylinder connector of the air supply unit is a single component, which has a more compact structure than that of the cylinder connected to the air bottle in the customary shell-type toy long gun, and the production cost is lower, which is of economic efficiency and practical value.

However, the above is only one of the better embodiments of the present invention, and should not be used to limit the scope of patent protection of the present invention. Any simple equivalent changes and substitutions made in accordance with the scope of patent application and the content of the specification of the present invention should still be covered by the scope of protection of the scope of patent application of the present invention.

What is claimed is:

1. An improved shell-throwing toy long gun, comprising a gun body, an air-control unit, a striking unit, a high-pressure air supply unit, and a magazine; wherein the gun body comprises a detachable lower body and an upper body; the lower body includes a magazine socket and a grip; the upper body has a shell-ejecting port on one side and a gun mechanism inside; the air-control unit and the striking unit are located inside the lower body; the high-pressure air supply unit is located in the grip, configured to output high-pressure gas to the air-control unit; the magazine is detachably inserted into the magazine socket; the air-control unit comprises a lower control module and an upper control module; the high-pressure gas output from the air supply unit can be transmitted to the gun mechanism via the lower and upper control modules, enabling movement of the gun mechanism through high-pressure gas; bullets loaded into the lower body from the magazine can be ejected through the shell-ejecting port by the action of a piston in the gun mechanism; the air supply unit connects to the lower control module; the striking unit connects to one end of the upper control module, within which is installed a valve assembly; one end of the valve assembly corresponds to a hammer in the striking unit; the valve assembly controls whether high-pressure gas flows from the lower control module to the gun mechanism, comprising:

the valve assembly comprises a valve stem, an air outlet, a sleeve ring fitted on the outer side of the valve stem, a sleeve, and a spring; the valve stem is rod-shaped with an internal air passage extending from one end to an air inlet hole on the side of the valve stem; one end of the valve stem corresponds to a hammer in the striking unit, such that when the hammer strikes the valve stem, it moves; the air outlet is fixed inside the upper control module, taking a hollow cylindrical form for outputting high-pressure air from the air passage; one end of the air outlet has a first connecting pipe; the sleeve ring and sleeve are fitted at both ends of the valve stem; the sleeve ring is fixed inside the upper control module to cover the air inlet hole; when the valve stem moves, the air inlet hole is exposed, corresponding to an air duct in the lower control module; the sleeve is hollow cylindrical, with a fixing section at one end and a second connecting pipe at the other; one end of the spring is attached to the fixing section, and the other end is attached to a retaining ring on the valve stem's outer side; the second connecting pipe connects to the first connecting pipe, covering the air passage and preventing leakage of high-pressure air.

2. The shell-throwing toy long gun as claimed in claim 1, wherein the valve stem comprises a rod body that includes a first section and a second section, the outer diameter of the second section being larger than that of the first section; one end of the first section corresponds to the hammer; a retaining ring and an air inlet hole are positioned on the second section near the first section; the air inlet is closer to the first section than the retaining ring; the air passage extends from the air inlet hole to the other end of the second section; the sleeve ring is placed on the outer side of the second section, and the retaining ring is pressed against one end of the sleeve ring by the spring's tension.

3. A shell-throwing toy long gun as claimed in claim 2, wherein the air outlet comprises a cylindrical tube with a first connecting pipe and an insertion part located at both ends of the tube; the inner diameter of the tube is larger than the outer diameter of the second section of the valve stem.

4. The shell-throwing toy long gun as claimed in claim 3, wherein the fixing section of the sleeve is ring-shaped with an inner diameter larger than the outer diameter of the second section of the valve stem, and the inner diameter of the second connecting pipe is larger than that of the fixing section.

5. The shell-throwing toy long gun as claimed in claim 4, wherein a leak-proof ring is further fixed within the first and second connecting pipes, the inner diameter of the leak-proof ring being larger than the outer diameter of the second section of the valve stem.

6. The shell-throwing toy long gun as claimed in claim 5, wherein the inner end of the first connecting pipe has a first end face, and the inner end of the second connecting pipe has a second end face; the leak-proof ring is clamped between the first and second end faces.

7. The shell-throwing toy long gun as claimed in claim 4, wherein the inner side of the first connecting pipe and the outer side of the second connecting pipe each have a threaded section, enabling the first and second connecting pipes to be screwed together.

8. The shell-throwing toy long gun as claimed in claim 2, wherein the fixing section of the sleeve is ring-shaped with an inner diameter larger than the outer diameter of the second section of the valve stem, and the inner diameter of the second connecting pipe is larger than that of the fixing section.

9. The shell-throwing toy long gun as claimed in claim 8, wherein a leak-proof ring is further fixed within the first and second connecting pipes, the inner diameter of the leak-proof ring being larger than the outer diameter of the second section of the valve stem.

10. The shell-throwing toy long gun as claimed in claim 9, wherein the inner end of the first connecting pipe has a first end face, and the inner end of the second connecting pipe has a second end face; the leak-proof ring is clamped between the first and second end faces.

11. The shell-throwing toy long gun as claimed in claim 8, wherein the inner side of the first connecting pipe and the outer side of the second connecting pipe each have a threaded section, enabling the first and second connecting pipes to be screwed together.

12. The shell-throwing toy long gun as claimed in claim 2, wherein an airtight ring is further installed between the retaining ring and the air inlet port, the airtight ring being affixed to one end of the sleeve ring.

13. The shell-throwing toy long gun as claimed in claim 1, wherein one end of the upper control module is further provided with an air guide block made of elastic material with an L-shaped air outlet channel inside; one end of the air outlet has an insertion part that connects to one end of the air outlet channel, while the other end connects to the gun mechanism.

14. The shell-throwing toy long gun as described in claim 13, wherein the interior of the upper control module has a two-ended open space for containing the valve assembly; the air guide block is positioned at one end, while the end of the valve stem corresponding to the hammer is positioned at the other end of the space.

15. The shell-throwing toy long gun as claimed in claim 1, wherein the inner side of the first connecting pipe and the outer side of the second connecting pipe each have a threaded section, enabling the first and second connecting pipes to be screwed together.

16. The shell-throwing toy long gun as claimed in claim 1, wherein an airtight ring is further installed between the retaining ring and the air inlet port, the airtight ring being affixed to one end of the sleeve ring.

17. The shell-throwing toy long gun as claimed in claim 1, wherein several airtight rings are further installed on the outer side of the air outlet and sleeve ring, pressing against the interior of the upper control module.

18. The shell-throwing toy long gun as described in claim 1, wherein the air supply unit comprises a gas cylinder connector and an elastic element; the gas cylinder connector is positioned inside the grip to output high-pressure gas from a gas cylinder to the air-control unit; the gas cylinder connector includes a screw and a puncture nozzle; the screw is detachably locked within the grip; the puncture nozzle is cone-shaped and located at one end of the screw to pierce the gas cylinder; an air hole extends from the puncture nozzle through the screw; the elastic element is positioned between the gas cylinder connector and the gas cylinder.

19. The shell-throwing toy long gun as claimed in claim 18, wherein the gas cylinder connector further includes a locking section located at the end of the screw near the puncture nozzle; it is configured for rotation and locking of the gas cylinder connector into the grip with a hand tool.

20. The shell-throwing toy long gun as claimed in claim 19, wherein the locking section has a recess, in which the puncture nozzle is positioned.

* * * * *